United States Patent [19]

Balzer et al.

[11] 4,184,298

[45] Jan. 22, 1980

[54] EXPANSION JOINT FILLER STRIP AND COVER ASSEMBLY

[75] Inventors: Claude P. Balzer; Edward M. Corman, both of Wichita, Kans.

[73] Assignee: Balco, Inc., Wichita, Kans.

[21] Appl. No.: 944,086

[22] Filed: Sep. 20, 1978

[51] Int. Cl.[2] ..... E01C 11/10; E04B 1/68

[52] U.S. Cl. ..... 52/396; 14/16.5; 52/288; 52/573; 404/67

[58] Field of Search ..... 52/396, 395, 461, 278, 52/288, 573; 404/67, 68, 69; 14/16.5

[56] References Cited

U.S. PATENT DOCUMENTS

| | | | |
|---|---|---|---|
| 942,693 | 12/1909 | Wintermute | 403/276 |
| 3,124,047 | 3/1964 | Graham | 52/396 X |
| 3,165,986 | 1/1965 | Hirst et al. | 404/47 |
| 3,165,987 | 1/1965 | Hirst et al. | 404/47 |
| 3,316,574 | 5/1967 | Pare | 14/16.5 |
| 3,331,294 | 7/1967 | Waller | 404/66 |
| 3,344,720 | 10/1967 | Hallock | 404/47 |
| 3,390,501 | 7/1968 | Driggers | 52/395 |
| 3,447,430 | 6/1969 | Gausepohl | 404/69 |
| 3,527,009 | 9/1970 | Nyquist | 52/288 |
| 3,570,378 | 3/1971 | Honegger | 404/69 |
| 3,606,826 | 9/1971 | Bowman | 404/67 X |
| 3,720,474 | 3/1973 | Stog et al. | 404/47 |
| 3,797,188 | 3/1974 | Mansfeld | 52/396 |
| 3,880,539 | 4/1975 | Brown | 52/396 X |
| 3,918,824 | 11/1975 | Bowman | 404/64 |

FOREIGN PATENT DOCUMENTS

| | | | |
|---|---|---|---|
| 241514 | 7/1965 | Austria | 404/68 |
| 1945534 | 9/1970 | Fed. Rep. of Germany | 14/16.5 |
| 75392 | 7/1949 | Norway | 403/276 |
| 1191502 | 5/1970 | United Kingdom | 52/573 |

OTHER PUBLICATIONS

Balco Expansion Joint Covers, Balco Catalog No. 17, 1977, 16 pages, Balco Inc. 115 No. Mead, Wichita, Kansas 67202.

*Primary Examiner*—Alfred C. Perham
*Attorney, Agent, or Firm*—Fishburn, Gold & Litman

[57] ABSTRACT

An expansion joint filler strip and cover assembly for a joint formed by spaced structural sections includes elongate base members secured to respective structural sections and having a joint therebetween. The base members have spaced apart, upstanding first and second and third walls with the third wall being substantially contiguous with the joint forming wall surface of the respective structural section. The first and second wall portions define an elongate, channel therebetween and the second and third wall portions define an elongate, recess therebetween with the third wall portion terminating in an edge spaced below the terminating edges of the first and second wall portions. A replaceable, elastomeric strip extends across the joint and has side portions secured to the base members with at least one side portion having an elongate flange received within the elongate recess and an outer surface even with the terminating edges of the first and second wall portions. An elongate cover member engaged with the terminating edges of the first and second wall portions and the elastomeric strip. An elongate tongue is received into the channel between the first and second wall portions. Preferably, clips in the channels provide an interference engagement with the first and second wall portions and the cover member tongue for retaining the cover member and the side portion of the elastomeric strip on the respective base member.

8 Claims, 6 Drawing Figures

EXPANSION JOINT FILLER STRIP AND COVER ASSEMBLY

The present invention relates to expansion joint cover assemblies and more particularly to expansion joint cover assemblies for covering the joints between adjacent portions of spaced structural sections which are adapted to contribute concealment and accommodate movement of such structural sections.

It is well known that in building structures of monolithic concrete, concrete blocks, bricks and the like, it is necessary and sometimes required by building codes to provide relatively long walls, ceiling and floors with expansion joints to prevent cracks in the structures due to expansion and contraction of the structural sections. Further, earth movement due to earthquake and other phenomenon, either natural or unnatural, can cause relative movement between adjacent building sections and therefore, expansion joints must be provided to prevent cracking under such conditions. Moreover, many architects seek cover structures which are particularly inconspicious and characterized by durability and suitability for the particular structure in combination with minimal use of metal strips or moldings.

The principal objects of the present invention are: to provide an expansion joint filler strip and cover assembly to cover expansion joints between spaced building sections, such as floors and walls, which remedy the above mentioned difficulties; to provide such a structure adapted to cover an expansion joint between adjacent structural sections having concrete, masonry, asphalt or metal and combinations thereof with portions of the assembly accommodating relative movement between the adjacent structural sections in any direction; to provide such a structure wherein the load bearing capacity thereof is not substantially affected by relative movement between adjacent building structural sections; to provide such a structure with load bearing support members providing for high load capacity and a compact assembly; to provide such a joint cover assembly which the parts thereof may be produced by extrusion processes for economy of manufacture and simplicity of assembly; to provide such a joint cover assembly with retainer strips that are pressed into place and held by fasteners which are hidden from view; to provide such a joint cover assembly in which the fasteners for the retainer strips are a plurality of spaced clips and the retention force may be varied by varying the number and spacing of the clips; to provide such a structure in which the filler strip thereof is removable and replaceable; to provide such a structure which little metal work thereof is visible in the finished assembly; and to provide such a structure that is attractive, easy and inexpensive to manufacture, that requires a minimal number of parts and that is easy to install and repair.

Other objects and advantages of this invention will become apparent from the following detailed description taken in connection with the accompanying drawings wherein are set forth by way of illustration and example, certain embodiments of this invention.

Figure 1:
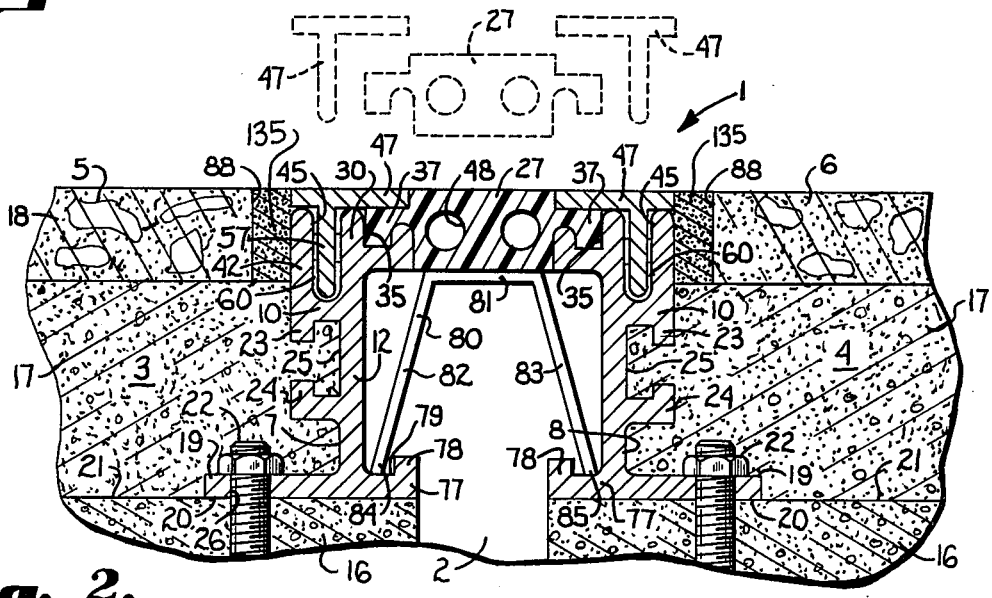
FIG. 1 is a transverse sectional view of the expansion joint and filler strip cover assembly embodying the present invention and shown in connection with adjacent structural sections.

Referring more in detail to the drawings:

Detailed embodiments of the invention are disclosed herein as required, however, it is to be understood that the disclosed embodiments are merely exemplary and that the invention may be embodied in many forms different from the illustrative embodiments present herewith. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates an expansion joint filler strip and cover assembly overlying an elongate joint or space 2 between adjacent portions of a building structure having structural sections 3 and 4 with parallel wall surfaces spaced apart and forming the joint. The structural sections 3 and 4 may be floor, wall or ceiling sections and may be constructed from monolithic concrete, building blocks, bricks, metal, asphalt, and any combination thereof or other suitable materials. The expansion joint filler strip and cover assembly 1 is adapted to permit and accommodate relative movement between the adjacent structural sections 3 and 4 in any direction. The structural sections 3 and 4 preferably have outer surfaces 5 and 6 finished with tile, terrazzo or the like, and have respective recesses 7 and 8 formed around portions of the expansion joint filler strip and cover assembly 1.

The cover assembly 1 includes elongate, rigid, base members 10 extending along and secured to respective structural sections 3 and 4 and having the joint 2 therebetween. The base members 10 are received within corresponding recesses 7 and 8 of the respective structural sections 3 and 4 and are preferably formed of metal, such as stainless steel, aluminum or brass and of a structure adapted for manufacture by an extrusion process. Each base member 10 has a body portion 12 generally perpendicular to outer surfaces 5 and 6 and terminating a slight distance therebelow. A flange 19 extends perpendicularly to the body portion 12 and into a setting bed 17 which is preferably formed therearound, as by pouring and has a face portion 20 engaging the surface 21 of a structural floor member 16. Bores 26 in the flanges 19 receive suitable fasteners 22, such as anchor bolts, J-bolts or the like set in the floor member 16 for anchoring the base member 10 thereto.

The body portion 12, FIG. 1, extends upwardly of the flange 19 and is contiguous to the joint 2. In the illustrated example, respective upper and lower tongues 23 and 24 extend perpendicularly outward and toward the setting bed 17 from a midportion of the body member 12 and define a recess 25 which can be used for insertion of anchor bolts or the like, or may be substantially filled with floor material, such as poured concrete and, in combination with the flange 19 connected to the structural floor member 16, anchors or secures the base members 10 to the respective structural sections 3 and 4.

The body portion 12 provides support for an elongate, longitudinally extending replaceable resilient strip 27 of a suitable synthetic elastomer, such as urethane or vinyl and is of the same width as the joint 2. A first wall portion 29 extends perpendicularly from the body portion 12 adjacent an upper end 3 thereof and is substantially contiguous with the wall surface of the joint 2. A lip portion 31 extends upwardly from the end of the first wall portion 29 and has a curved edge surface 32 for ease of engagement with corresponding portions of the elastomeric strip 27, described below.

The body portion 12 extends upwardly past the junction thereof with the first wall portion 29 and into a second wall portion 30 extending vertically higher than the lip portion 31 and terminating in a curved edge surface 34. The first and second wall portions 29 and 30 define an elongate, longitudinally extending recess 35 therebetween for receiving a correspondingly shaped laterally extending side portion 37 of the elastomeric strip 27.

A third wall portion 42 extends outwardly of the body member 12 and terminates in a curved edge surface 43 spaced adjacently of the second wall portion 30 and even with the curved edge surface 32 of the second wall portion 30. The second and third wall portions 30 and 42 define an elongate, longitudinally extending channel 45 therebetween which opens to the surface of the respective structural sections 3 and 4.

The base member 10 provides support for the elastomeric strip 27 and an elongate anchor cover member 47 which anchors the elastomeric strip 27 to the base member 10 and conceals the seam or joint therebetween. In the illustrated example, the elastomeric strip 27 and an elongate anchor cover member 47 which anchors the elastomeric strip 27 has planar upper and lower outer surfaces 49 and 50 and internal openings 48 of selected sizes or shapes to effect a desired flexibility and resistance to sagging. The elastomeric strip 27 has lateral extending side portions 37 with a downwardly extending elongate flange 38 received in the recess 25 to prevent the elastomeric strip 27 from being pulled away from the base member 10 during relative movement of the structural sections 3 and 4. The flange 38 forms one side of an upwardly extended elongate, longitudinal groove 33 between the flange 38 and the midportion of the elastomeric strip 27 and into which the curved edge surface 32 of the first wall portion 29 is received. The upper outer surface 49 is substantially even with the terminating curved edge surfaces 34 and 43 of the second and third wall portions 30 and 42. An elongate recess 51 extends beside the side portion 37 and adjacent the upper outer surface 49 for receipt of the anchor cover member 47.

Figure 2:
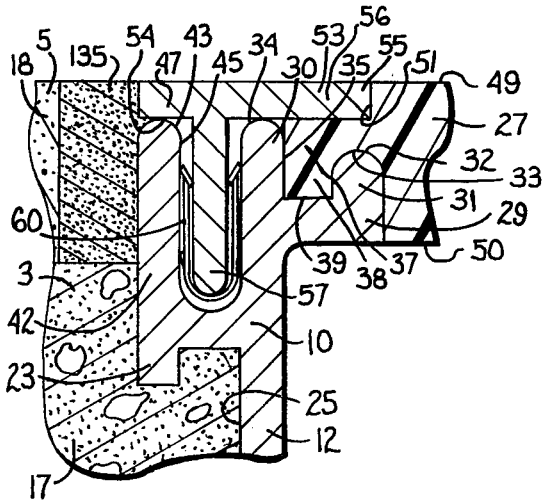
FIG. 2 is an enlarged, fragmentary view of the expansion joint and filler strip cover assembly showing details of connection between various members thereof.
Figure 3:
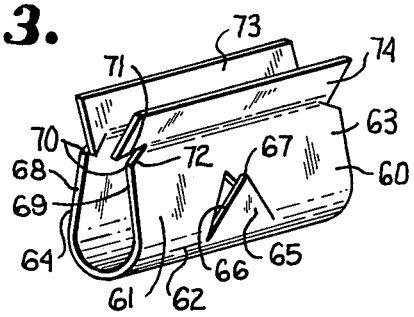
FIG. 3 is an enlarged, perspective view of the fastening clip used in connection with the expansion joint and filler strip cover assembly.

The anchor cover member 47 is preferably formed of metal, such as stainless steel, aluminum or brass, and is of a structure adapted for manufacture by an extrusion process. In the illustrated example, the anchor cover member 47 has a plate portion 53, FIG. 2, with an upper outer surface 54 level with the adjacent structural section surface 5 or 6 and the upper outer surface 49 of the elastomeric strip 27 and a lower outer surface 50 engaged with the terminating curved edge surfaces 34 and 43 of the supporting second and third wall portions 30 and 42. An end portion 56 of the plate portion 53 is received within the elongate recess 51 and over the side portion 37 of the elastomeric strip 27. An elongate tongue 57 is connected to the plate portion 53 of the anchor cover member 47 and extends outwardly thereof and inwardly into the channel 45 between the second and third wall portions 30 and 42.

In the illustrated example, an elongate tongue 57 is engaged within the channel 45 by fastening clips 60, each comprising a substantially U-shaped body 61 having a base 62 with opposed, upstanding side walls 63 and 64. A pair of first engaging edges 65 are provided at the medial portion of the clip body 61 and each includes a Vee-shaped free edge 66 which projects outwardly of the associated clip side walls 63 and 64 and includes an apex 67 oriented away from the base 62. The apex 67 is quite sharp and is adapted to gouge or cut into an associated interior surface of the slot 45. In the illustrated example, the edge 66 is formed by slitting associated portions of the clip side walls 63 and 64 and bending that portion outwardly. The first engaging edge 65 is therefore in the form of a flap or tab which is resiliently flexible at the free edge 66 and the bottom of the same is integrally attached to the clip base 62, thereby permitting downward translation of the clip 60 into the slot 45 but preventing or resisting relative translation in the reverse or opposite direction.

The clip side walls 63 and 64 each include a pair of end edges 68 and 69 respectively which have an inwardly projecting cut or slit 70 adjacent an upward portion thereof. The cut or slit 70 defines upper and lower portions 71 and 73 of each edge of which the former is bent inwardly, is sharp, and forms edges which bite into the associated surfaces of the slot 45, thereby permitting downward translation of the elongate tongue 57 into the clip 60, yet preventing or resisting relative translation in the reverse direction. Upper portions 73 and 74 are flared outwardly of the body 61 for facilitating receipt of elongate tongue 57 therein.

Once engaged within the elongate channel 45, the anchor cover member 47 acts as a fastener or anchor to maintain the side portion 37 of the elastomeric strip 27 connected to the base member 10.

In the illustrated structure of FIG. 1, the base member 10 includes an arm 77 extending oppositely of the flange 19 and substantially contiguous with the wall surface of the joint 2. An elongate lip 78 at the end of the arm 77 in combination with the body portion 12 forms a recess 79 therebetween for receiving an elongate support 80 underlying the elastomeric strip 27. An elongate support 80 is preferably of a resilient material, such as vinyl, and having sufficient rigidity for support. The support 80 is in the form of an inverted U having a planar top member 81 with opposite diverging side walls 82 and 83 having respective ends 84 and 85 received within the recesses 79 of opposite base members 10. The planar top member 81 engages the lower outer surface 50 of the elastomeric strip 27 and provides support for loading on the elastomeric strip 27. Preferably, the side walls 82 and 83 have sufficient resiliency whereby loads may be placed upon the elastomeric strip 27 which is supported against sagging by the support 80.

The expansion joint filler strip and cover assembly 1 is adapted for various applications to cover a joint between two structural sections such as floor sections, FIG. 1. The sections of floor may be new or one floor section may be old and the other floor section may be a new section as when adding an addition to an older building structure. Securing the base member 10 within respective structural sections 3 and 4 is preferably accomplished by positioning a pair of opposed base members 10 adjacent the joint 2 and laying a protective pouring form adjacent the third wall portion 42 so that pouring material, such as concrete, does not slop into the channel 45. The flanges 19 are connected to the structural floor member 16 by the fasteners 22 and a setting bed 17 is then formed, as by pouring atop the structural floor member 16 and against the base member 10 whereby floor material hardens over the flange 19 and enters the recess 35. An elongate recess 88, FIG. 1, is formed upon removal of the protective pouring form.

Next, the support 80 is inserted between opposed wall members 10 and the ends 84 and 85 thereof fitted into respective elongate recesses 79. Then the elastomeric strip 27 is mounted to the opposed base members 10 by urging the side portions 37 into the respective recesses 35. The fastener clips 60 are then urged onto the elongate tongue 57 of the anchor cover member 47 at spaced intervals and then the tongue 57 urged into the channel 45 whereby the end portion 56 of the plate portion 53 is received within the elastomeric strip recess 51. Commensurately, the lower outer surface 55 of the plate portion 53 engages the terminating curved edge surfaces 34 and 43 of the second and third wall portions 30 and 42. The recess 88 is then filled with grout or a similar substance to complete assembly of the expansion joint filler strip and cover assembly 1.

It will be appreciated that the assembly 1 permits four-way movement between the structural sections 3 and 4 while providing a load bearing cover across the joint 2. Relative horizontal, vertical, slip and twisting movements are accommodated within the range of stretching and flexure of the elastomeric strip 27. Moreover, open seams which would otherwise tend to trap and collect dirt or grime are substantially covered by snug engagement of the anchor cover member 47 with the elastomeric strip 27 and the base member 10.

Figure 4:
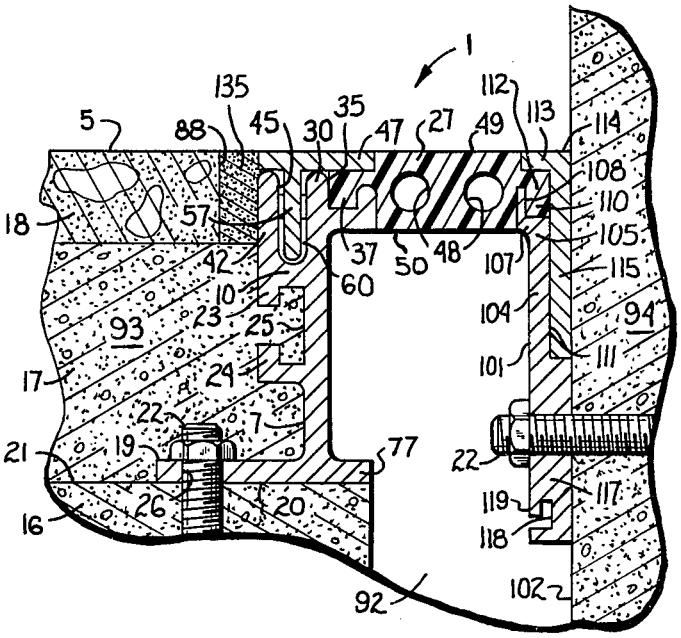
FIG. 4 is a transverse sectional view of a form of expansion joint and filler strip cover assembly for use with floor to wall expansion joints.
Figure 5:
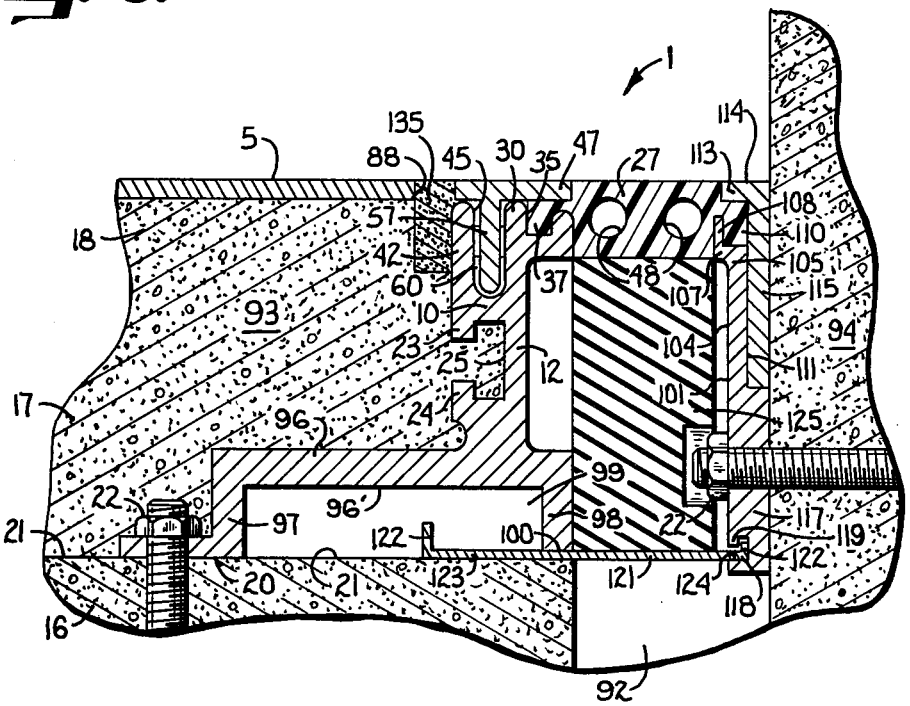
FIG. 5 is a transverse sectional view of a modified form of expansion joint and filler strip cover assembly for use in connection with floor to wall expansion joints.

Modified forms of the assembly 1 are illustrated in FIGS. 4 and 5 and are adapted for use covering an elongate expansion joint 92 between a floor structure section 93 and a wall structural wall section 94. The base member 10, FIG. 4, is substantially as described in connection with FIGS. 1 and 2 and is mounted in the floor structural section 93 and substantially contiguous with the wall surface of the joint 92. The form of the assembly 1 shown in FIG. 4 is intended to be used in those areas where little or no load would be positioned on the elastomeric strip 27 and accordingly, support therefor, as for example the support 80, is not required. The base member 10, FIG. 4, has a straight arm 77 extending oppositely of the bottom flange 19 and is without an upturned lip or other catching means to hold a support.

Opposite the base member 10 and secured to a joint surface 102 of the wall structural section 94 adjacent and spaced from the base member 10 on the floor structural section 93 is a base member 101. The base member 101 is secured at its lower end to the wall structural section 94 by a fastener 22 and has a body portion 104 intermediate of an upper end 105 and the fastener 22 and is adjacent and spaced from the joint surface 102 and defining an elongate, longitudinally extending channel 111. An upper wall portion 107 is positioned adjacent the joint surface 102 and spaced therefrom a distance further than the body portion 104 and defines an elongate, longitudinally extending, recess 108 for receiving a correspondingly shaped, lateral extending side portion 112 of the elastomeric strip 27.

An elongate, longitudinally extending, anchor cover member 113 has a plate portion 114 extending between the joint surface 102 and atop the side portion 112 of the elastomeric strip 27. An elongate, longitudinally extending, tongue 115 is received in the channel 111 and anchored therein.

A lower end 117 of the base member 101 includes an elongate, longitudinally extending slot 118 opening to the joint 92 and a lip 119 overlying a portion of the slot 118 and providing a recessed receptacle for insertion of a drainage plate 121, described below in connection with FIG. 5.

In the modified form of the expansion joint filler strip and cover assembly 1 shown in FIG. 5, the base member 10 includes an elongate, longitudinally extending lower flange 96 extended outwardly of the body portion 12 a distance further than the flanges 19 of FIGS. 1 and 4. The lower flange 96 has spaced legs 97 and 98 depending therefrom and defining an elongate, longitudinally extending recess 99 between the undersurface 96' of the flange 96 and the surface 21 of the structural floor member 16. The leg 98 terminates short of the surface 21, thereby retaining an opening 100 for a purpose later described.

A resilient, elongate, longitudinally extending filler strip 125 of suitable material, such as processed cork embeded in a synthetic matrix, polyurethane foan or the like, is formed in strips thereof and laid into the joint 92. Preferably, the filler strip 125 substantially occupies the joint 92 and extends between the lower outer surface 50 of the elastomeric strip 27 in order to support same and a drainage and support plate 121 extending between respective bottom portions of the base members 10 and 101. The filler strip 125 is intended for use where loads would be normally placed upon the elastomeric strip 27 and resists downward sagging of the same by serving as a supportive block therefor.

The drainage and support plate 121 has opposite ends 123 and 124 each with upwardly extending flanges or arms 122. The arms 122 are respectively engaged within the recess 99 and the slot 118 whereby the arm 122 in the slot 118 is retained therein and the arm 122 within the recess 99 is positioned therein for lateral sliding movement along the structural section surface 21. The plate 121 slides under the leg 98 and through the opening 100 to provide for expansive movement of the joint 92 and the base member 10 toward and away from the base member 101. The drainage plate 121 catches and conveys any moisture which seeps through the elastomeric strip 27 and the filler strip 125 to a suitable disposable point or means.

Figure 6:
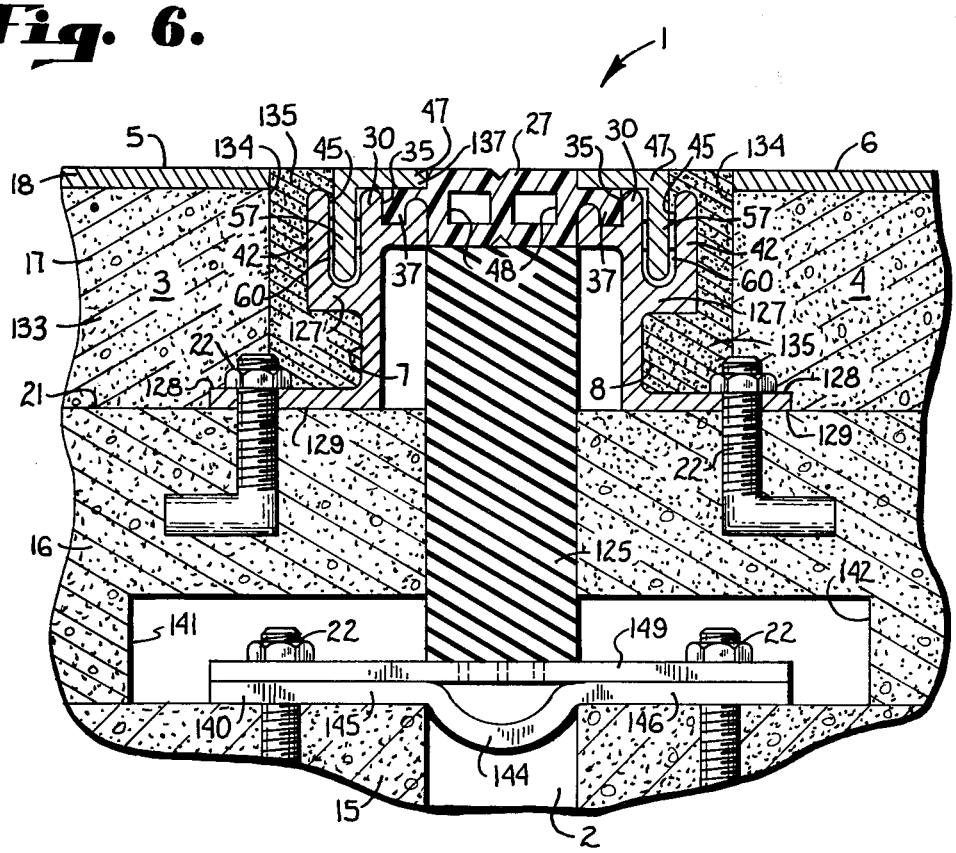
FIG. 6 is a transverse sectional view of the modified form of expansion joint and filler strip cover assembly and shown in connection with a floor to floor expansion joint.

Another modified form of expansion joint filler strip and cover assembly 1 is illustrated in FIG. 6 and is adapted for floor to floor installations having relatively thin setting beds 133. A base member 127 is similar in structure to the base member 10, FIGS. 1 through 5, like portions having like numbers, and includes a bottom flange 128 having a lower surface 129 thereof engaging the upper surface 21 of the structural floor member 16.

A recess 134 between the setting bed 133 and the base member 127 extends from the surface 5 to the surface 21 of the structural floor member 16 and, after installation of an anchor cover member 137, may be filled with grout material 135.

The expansion joint filler strip and cover assembly 1, FIG. 6, is shown in connection with a gutter assembly 140 for drainage of the joint 2 whereby recesses 141 and 142 are formed in the structural floor member 16 and atop the structural floor 15 during laying of the floor member 16. A U-shaped channel member 144 having outwardly extending flanges 145 and 146 is positioned across adjacent structural sections 3 and 4 whereby the lowest part of the channel member 144 lies across the joint and flanges 145 and 146 overlie adjacent portions of the structural floor 15. A perforated cover plate 149 overlies the channel member 144 and fasteners 22, such as bolts, anchor the cover plate 149 and the flanges 145 and 146 to the structural floor 15. The gutter assembly 140 provides for drainage of the expansion joint 2 by catching moisture seeping through the assembly 1 and conveying the moisture to a suitable disposable point or means (not shown). The gutter assembly 140 is preferably constructed of a resilient and flexible material, such as a synthetic plastic, permitting relative movement of the structural sections 3 and 4.

The resilient, supportive, elongate, longitudinally extending filler strip 125 extends between the cover plate 149 and the lower outer surface 50 of the elastomeric strip 27 for providing support for the elastomeric strip 27 against loading thereon.

It is to be understood that while certain forms of the invention have been illustrated and described, it is not to be limited to specific forms or arrangement of parts herein described and shown, except to the extent that such limitations are set forth by the following claims.

What is claimed and desired to secure by Letters Patent is:

1. An expansion to joint filler strip and cover assembly for a joint formed by spaced structural sections having substantially parallel wall surfaces forming the joint, said assembly comprising:

(a) elongate base members extending along and secured to respective structural sections having a joint therebetween, at least one of said base members having a body portion with spaced apart, upstanding first, second and third wall portions having respective terminating edges and with the first wall portion being substantially contiguous with the joint forming wall surface of the respective structural section, the first and second wall portions defining an elongate, longitudinally extending recess therebetween and said second and third wall portions defining an elongate, longitudinally extending channel therebetween;

(b) a replaceable, elongate, elastomeric strip traversing said joint and having upper and lower outer surfaces and lateral extending side portions secured relative to respective base members;

(c) an elongate anchor cover member having a plate portion engaged with at least the terminating edge of said second wall portion and said upper outer surface of one side portion of said elastomeric strip;

(d) an elongate tongue on said plate portion of the anchor cover member and extending inwardly therefrom into said channel between said second and third wall portions; and (e) means in said channel and having interference engagement with said second and third wall portions for retaining the anchor cover member and a side portion of the elastomeric strip on the respective base member.

2. The expansion joint filler strip and cover assembly set forth in claim 1 wherein:

(a) said first wall portion has a terminating edge spaced below the terminating edge of said second wall portion; and (b) said elastomeric strip has at least one side portion having an outwardly extended flange received in said elongated recess between said first and second wall portions, said flange having an upper outer surface substantially even with the terminating edge of said second wall portion.

3. The expansion joint filler strip and cover assembly set forth in claim 2 wherein:

(a) said elastomeric strip has a midportion and said side portion flange is recessed from the midportion of said elastomeric strip with said flange upper outer surface being spaced below said midportion upper outer surface substantially the thickness of said anchor cover member plate portion for flush fit of said plate portion against said elastomeric strip midportion.

4. The expansion joint filler strip and cover assembly set forth in claim 3 wherein:

(a) the terminating edges of said second and third wall portions are level with each other; and (b) said anchor cover member plate portion engages the teminating edges of said second and third wall portions.

5. The expansion joint filler strip and cover assembly set forth in claim 1 wherein:

(a) said elastomeric strip has a midportion and lateral extending side portions having at least one side portion with an outwardly extended flange and an upwardly extending elongate groove between said flange and said side portion;

(b) said flange is received in said recess with said terminating edge of said first wall portion engaged in said groove and inhibiting lateral movement of said flange from said recess.

6. The expansion joint filler strip and cover assembly set forth in claim 1 wherein:

(a) said means in said channel include a plurality of clips having opposed side walls with sharp portions for engaging said channel and said tongue and removably resisting movement of said tongue from said channel.

7. The expansion joint filler strip and cover assembly set forth in claim 1 wherein:

(a) said base members respectively include elongate arm members extending toward and substantially contiguous with said joint, said arm members being spaced from said elastomeric strip; and including (b) a resilient support member having spaced diverging leg portions with ends thereof engaged with said arm members and supported thereby, said leg portions joined in an upper portion engaging and resiliently supporting said elastomeric strip between said base members for loads thereon.

8. The expansion joint filler strip and cover assembly set forth in claim 1 wherein:

(a) said base members respectively have body portion lower ends spaced from and below said first, second and third wall portions;

(b) an elongate, longitudinally extending connector member extending between said body portion lower ends and across said joint, said connector member being spaced from and below said elastomeric strip; and (e) a resilient strip substantially filling said joint and having a lower surface supported by said connector member and an upper surface engaging and resiliently supporting said elastomeric strip between said base members for loads thereon.

* * * * *